US006343640B1

(12) United States Patent
Reddy et al.

(10) Patent No.: US 6,343,640 B1
(45) Date of Patent: Feb. 5, 2002

(54) PRODUCTION OF METAL/REFRACTORY COMPOSITES BY BUBBLING GAS THROUGH A MELT

(75) Inventors: Ramana G. Reddy; Banqiu Wu, both of Tuscaloosa, AL (US)

(73) Assignee: The University of Alabama, Tuscaloosa, AL (US)

( * ) Notice: Subject to any disclaimer, the term of this patent is extended or adjusted under 35 U.S.C. 154(b) by 0 days.

(21) Appl. No.: 09/537,412

(22) Filed: Mar. 29, 2000

Related U.S. Application Data

(60) Provisional application No. 60/174,382, filed on Jan. 4, 2000.

(51) Int. Cl.[7] ..... B22D 23/00

(52) U.S. Cl. ..... 164/97; 420/590

(58) Field of Search ..... 164/97, 99, 101, 164/55.1, 66.1; 148/538, 549; 420/528, 548, 590; 428/545; 75/415, 680

(56) References Cited

U.S. PATENT DOCUMENTS 2,826,494 A * 3/1958 Drummond ..... 420/43
3,515,542 A * 6/1970 Larsen ..... 420/492
4,808,372 A * 2/1989 Koczak et al. ..... 420/457
5,334,236 A * 8/1994 Sang et al. ..... 75/415
5,626,692 A * 5/1997 Rohatgi et al. ..... 148/538
5,935,295 A * 8/1999 Megy ..... 75/680

FOREIGN PATENT DOCUMENTS

EP 0 483 184 B1 * 1/1994 ..... C22C/1/08

* cited by examiner

*Primary Examiner*—M. Alexandra Elve
*Assistant Examiner*—Kevin P. Kerns
(74) *Attorney, Agent, or Firm*—Oblon, Spivak, McClelland, Maier & Neustadt, P.C.

(57) ABSTRACT

A method of making metal/refractory composites includes bubbling a reactive gas through a melt to form a foam including refractory particles. In continuous mode, the foam is separated from the melt and the melt replenished. Composites of lightweight metals reinforced with discontinuous refractory ceramic particles can be efficiently and economically produced.

19 Claims, 8 Drawing Sheets

PRODUCTION OF METAL/REFRACTORY COMPOSITES BY BUBBLING GAS THROUGH A MELT

This application claims benefit to U.S. application Ser. No. 60/174,382, filed Jan. 4, 2000.

BACKGROUND OF THE INVENTION

1. Field of the Invention:

This invention relates to the production of metal/refractory composites. In particular, the invention relates to the production of composites of metals or alloys reinforced with discontinuous refractory particles formed by bubbling a reactive gas through a melt.

2. Background of the Invention

In recent decades, metal matrix composites have been developed with properties superior to those of traditional materials. Since the late 1980's, lightweight alloy matrix composites have been developed for many applications. In particular, discontinuously reinforced lightweight alloy matrix composites are rapidly emerging as new low cost alternatives to continuously reinforced composites for automobile and aerospace applications.

These discontinuously reinforced alloy composites are commercially produced by incorporating advanced ceramic particles into the molten alloy. High costs associated with industrial production of the advanced ceramic particles using an electric resistance furnace raise the costs associated with the composites.

Various attempts at in-situ formation of ceramic particles in an alloy matrix have been reported. For example, U.S. Pat. No. 5,626,692 discloses a method of making an aluminum-based metal matrix composite where a carbide reinforcement is produced from a solid carbon source. U.S. Pat. No. 4,808,372 discloses an in-situ process for producing a composite containing a refractory material dispersed in a solid matrix. However, the low production rates, complex methods of operation and high costs associated with these in-situ processes are not satisfactory.

SUMMARY OF THE INVENTION

The present invention provides a method of making a metal/refractory composite in which the composite metal matrix is reinforced with discontinuous refractory particles. According to the invention, a gas including at least one gaseous refractory forming component is bubbled through a melt including a metal matrix forming component and at least one molten refractory forming component. The bubbled gas forms a foam on top of the melt. Reaction of the gaseous refractory forming component and the molten refractory forming component forms refractory particles in the melt and in the foam. The refractory particles are enriched in the foam relative to the melt. When the foam breaks, a slurry containing the refractory particles is formed that can be cast in molds. Upon cooling, a solid metal/refractory composite is formed in which a metal or alloy is discontinuously reinforced with the refractory particles.

A continuous method of forming metal/refractory composites is provided by introducing the melt and gas to a melt container while removing the foam produced. High production rates with excellent compositional control are possible in a simple, easily controlled process using inexpensive raw materials.

These and other features and advantages of this invention are described in or are apparent from the following detailed description of the preferred embodiments.

BRIEF DESCRIPTION OF THE DRAWINGS

The preferred embodiments of this invention will be described below in detail with reference to the following drawings, wherein.

DETAILED DESCRIPTION OF PREFERRED EMBODIMENTS

Figure 1:
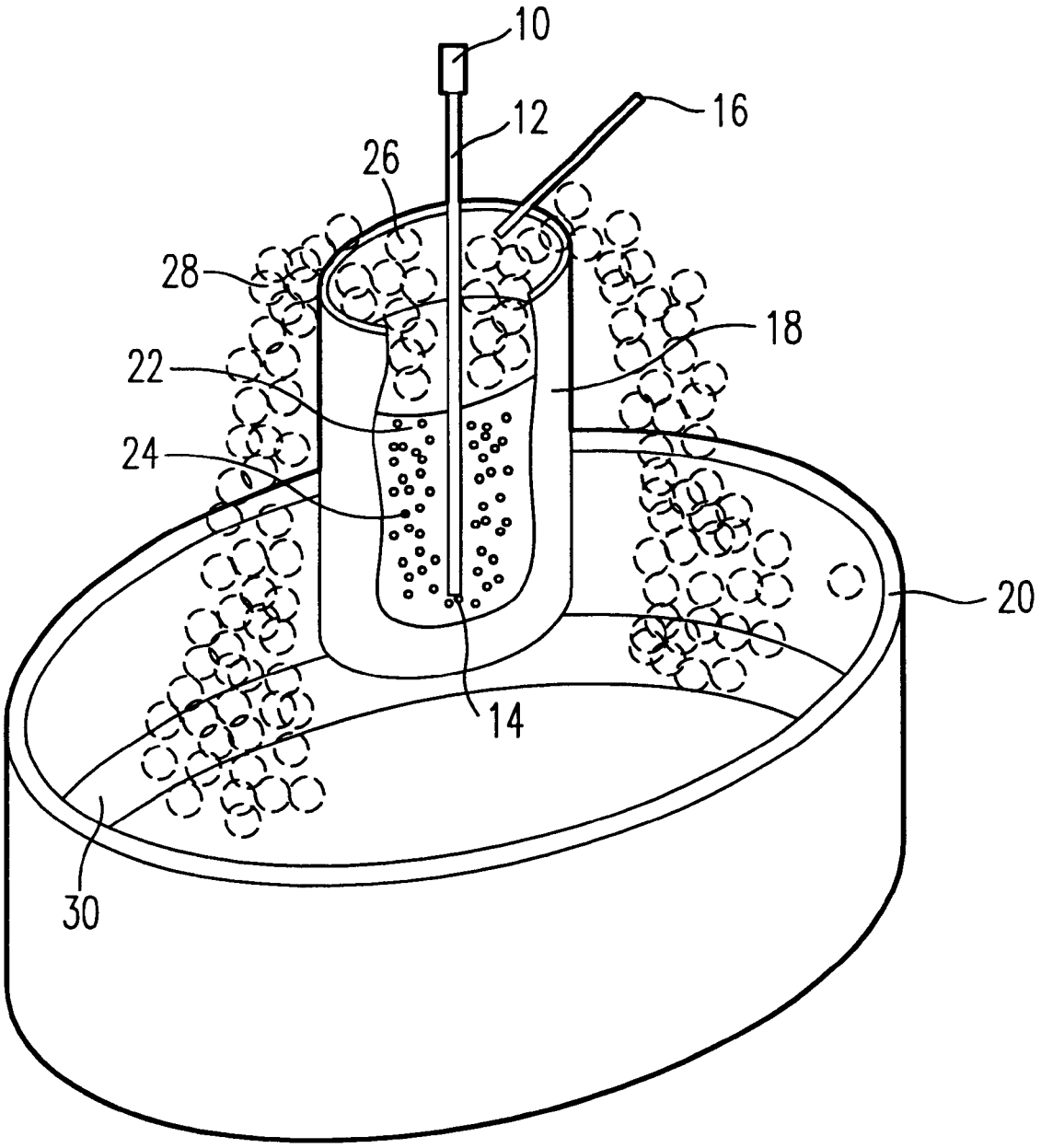
FIG. 1 shows an embodiment in which foam is produced by bubbling gas through a melt from a tube inserted into the melt.

The present invention provides a method of making a composite of discontinuous refractory particles reinforcing a metal matrix. The refractory particles are produced by bubbling a gas including a gaseous refractory forming component through a melt including a metal matrix forming component and at least one molten refractory forming component. The bubbled gas forms a foam above the melt while the gaseous refractory forming component in the gas reacts in-situ with the molten refractory forming component of the melt to form the refractory particles. When the foam breaks a slurry is formed containing the discontinuous refractory particles. Cooling solidifies the slurry and forms the metal/refractory composite.

The term "melt" as used herein refers to a liquid phase.

The term "refractory" as used herein designates or describes a material that is a solid at a temperature 50° C. above the freezing point of the melt. The refractory particles according to the invention can be a metallic alloy of at least one metallic element with at least one non-metallic element, or can be a non-metallic ceramic. In particular, the refractory particles can be metallic or non-metallic borides, carbides, nitrides and oxides of metallic and/or non-metallic elements. Preferably, the refractory particles are ceramic carbides, such as SiC.

The melt includes at least one molten refractory forming component dissolved in a metal matrix forming component. The molten refractory forming components can include one or more elements selected from boron, carbon, nitrogen, oxygen, silicon and transition metals. The metal matrix forming component can consist of one metal element, or can be an alloy including at least one metal element. The metal matrix forming component of the melt can include one or more liquid phases. Preferably, the metal matrix forming component includes a lightweight metal selected from beryllium, magnesium, aluminum and titanium.

The melt can be formed in a melt container by filling the melt container with raw material and then melting the raw material. Alternatively, the melt can be introduced to the melt container by feeding melt into the melt container. The melt can be fed into the melt container through a melt feed tube ending above the melt container and above the surface of the melt. Alternatively, the melt can be fed into the melt container through a melt feed tube opening within the melt in the melt container.

The term "tube" as used herein is not limited to hollow cylinders with circular cross-sections, but encompasses hollow conduits of all possible cross-sections, including triangular, square, rectangular, circular, oval, elliptical and corrugated cross-sections.

The gas bubbled through the melt contains at least one gaseous refractory forming component that reacts with the molten refractory forming component in the melt to form at least one refractory. Each of the gaseous refractory forming components can contain one or more elements selected from boron, carbon, nitrogen, oxygen, silicon and transition metals. The gaseous refractory forming components can also contain one or more elements, selected from hydrogen and the halogens, that promote delivery of the boron, carbon, silicon and transition metals as gases. Preferably, the transition metals are selected from Ti, V, Fe, Co, Ni, Nb, Mo, Ta and W. Preferably, the halogens are selected from fluorine and chlorine. Carbonyl (CO) compounds of transition metals can promote formation of gaseous refractory forming components containing the transition metals.

Examples of gaseous refractory forming components include diborane ($B_2H_6$), methane ($CH_4$), ammonia ($NH_3$), water ($H_2O$), silane ($SiH_4$) and titanium tetrachloride ($TiCl_4$). Gaseous refractory forming components in liquid form, such as ammonia ($NH_3$) and titanium tetrachloride ($TiCl_4$), can be easily transported and stored before being vaporized and bubbled through metal or alloy melts. Other gaseous refractory forming components, such as low molecular weight hydrocarbons, can be obtained as relatively inexpensive waste products of petrochemical processing. A preferable low molecular weight hydrocarbon is methane ($CH_4$).

The gas bubbled through melt can also contain various amounts of at least one nonreactive gas. The non-reactive gas can include an inert gas, preferably argon. Varying the ratio of the gaseous refractory forming component to the inert gas in the gas bubbled through the melt provides a means of controlling the formation of the refractory particles.

Manufacture of similar metal/refractory composites according to the invention can be approached in different ways. For example, Al/SiC composites can be made by bubbling $CH_4$ gas through an Al—Si melt, or by bubbling $SiH_4$ through an Al—C melt. The solubility of the molten refractory forming component in the metal matrix forming component of the melt will often dictate which pathway is preferable.

In batch embodiments of the present invention, the gas can be bubbled through the melt until most of the melt has been turned into foam. When the bubbling is stopped, the foam is allowed to break and a slurry containing the refractory particles is formed. The slurry can then be cast in a mold.

Preferably, in continuous embodiments of the present invention, the foam can be separated from the melt while replenishing the melt to replace the separated foam. The term "continuous" as used herein refers to embodiments in which the inflow of melt to the melt container roughly balances the outflow of foam separated from the melt container over a finite period of time. The melt replenishment process can be used to control the melt level and melt composition in response to any changes induced by the bubbling. The separated foam is collected away from the melt and allowed to break and form a slurry containing the refractory particles. The slurry can then be continuously cast.

Cooling the slurry forms a solid metal/refractory composite including the discontinuous refractory particles.

The present invention can be practiced using various configurations of processing equipment. Preferably, the equipment is heated to maintain the melt in the liquid phase and the gaseous refractory forming components in the gas phase.

In an embodiment shown in FIG. 1, a melt 22 is introduced from melt feed tube 16 into a melt container 18. A hollow gas feed tube 12 connected by gas connector 10 to a gas source (not shown) is partially immersed in melt 22. Gas flowing through one or more holes 14 in gas feed tube 12 form bubbles 24 that rise through melt 22 forming foam 26. Gaseous refractory forming components of the gas react with one or more molten refractory forming components of melt 22 forming refractory particles. Overflow foam 28 containing the refractory particles cascades over the side of melt container 18 and is collected in composite collector 20. The overflow rate can be controlled by the flow rate of gas bubbles. Overflow foam 28 breaks in composite collector 20 to form liquid composite 30.

The end of the gas feed tube immersed in the melt can be open or closed, and can have one or more holes through the tube wall arranged along the side of the tube. To maximize contact between the gas and the melt, preferably the holes have diameters of 1 mm or less.

Figure 2:
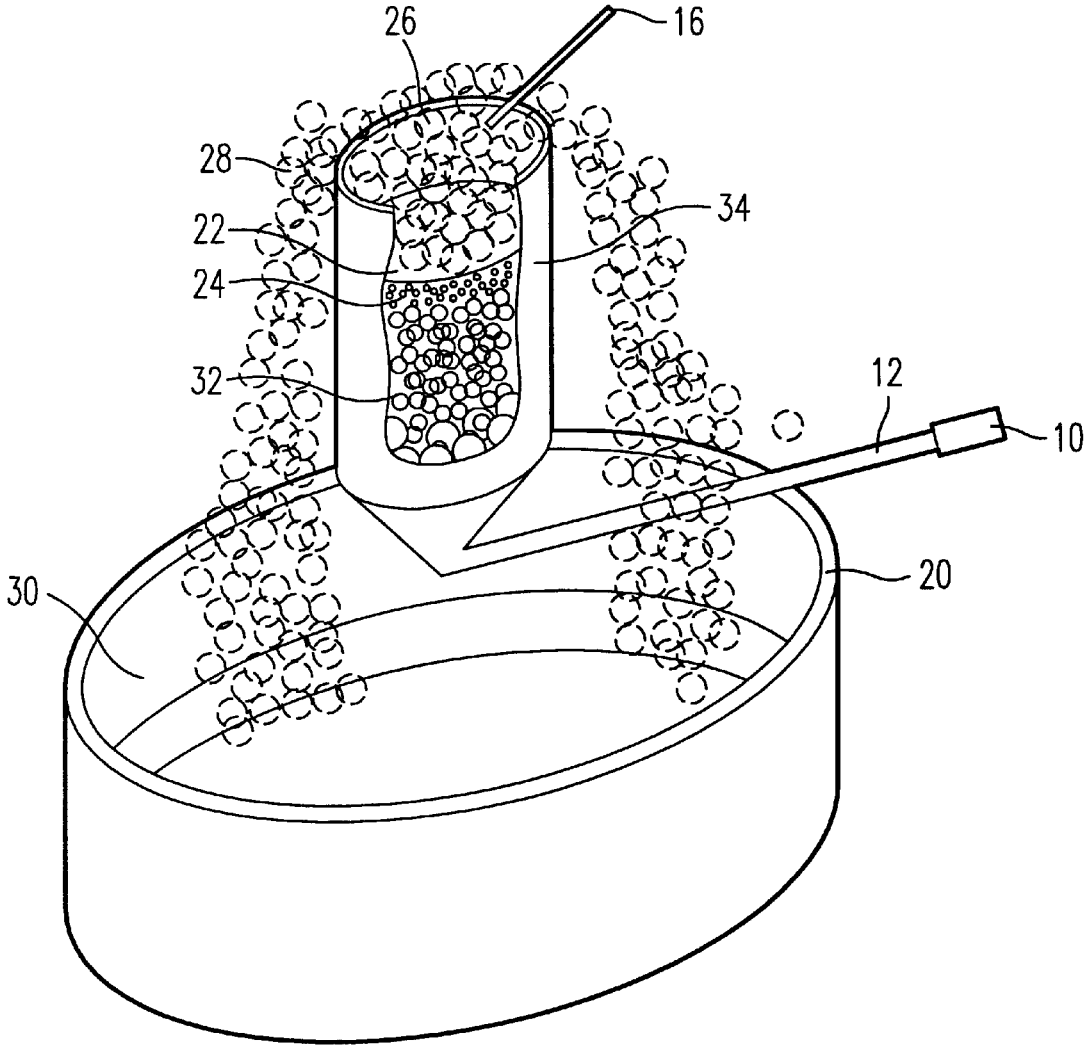
FIG. 2 shows an embodiment in which foam is produced by bubbling gas through a melt from an opening at the bottom of a melt container including a packed bed.

In another embodiment shown in FIG. 2, melt 22 is introduced from melt feed tube 16 to packed bed melt container 34 containing packed bed 32. Hollow gas feed tube 12 connected by gas connector 10 to a gas source (not shown) is also connected to the bottom of packed bed melt container 34. Gas flowing from gas feed tube 12 form bubbles 24 that rise up through packed bed 32 and melt 22 forming foam 26. Gaseous refractory forming components of the gas react with one or more molten refractory forming components of melt 22 forming refractory particles. Overflow foam 28 containing the refractory particles cascades over the side of packed bed melt container 34 and is collected in composite collector 20. The overflow rate can be controlled by the flow rate of gas bubbles. Overflow foam 28 breaks in composite collector 20 to form liquid composite 30.

EXAMPLE 100 g of a 3:1 mixture of pure aluminum powder and silicon powder is placed in a 100 ml alumina crucible serving as a melt container. The melt container is placed in a furnace on top of a larger diameter alumina crucible serving as a composite collector. An alumina tube connected to a gas source of 10 vol % $CH_4$ in Ar is placed above the powder in the melt container with the gas source OFF. The alumina tube is closed at the bottom but has three 1 mm diameter holes along the side of the tube. The process is monitored through an eyehole on the top of the furnace, and the temperature of the furnace is measured with a thermocouple.

The furnace is flushed with argon. The melt container is then heated under the argon atmosphere to a temperature of 950–1300° C. to form an aluminum-silicon melt. After 2–3 hours the $CH_4$/Ar gas source is turned ON, the alumina tube connected to the gas source is lowered into the melt, and the $CH_4$/Ar gas is bubbled into the melt. The gas bubbles form a foam of liquid Al—Si alloy enriched with SiC particles. The foam flows over the edge of the melt container and down into the composite collector under the melt container. Once in the composite collector, the foam breaks and forms a slurry containing the SiC particles. After bubbling the $CH_4$/Ar gas through the melt for 1 hour, the bubbling is stopped and the furnace is cooled to room temperature under a flow of argon.

The melt container and composite collector are taken out of the furnace for sampling and characterization. The composite sample from composite collector is found to have 20–25 wt % SiC.

Figure 3:
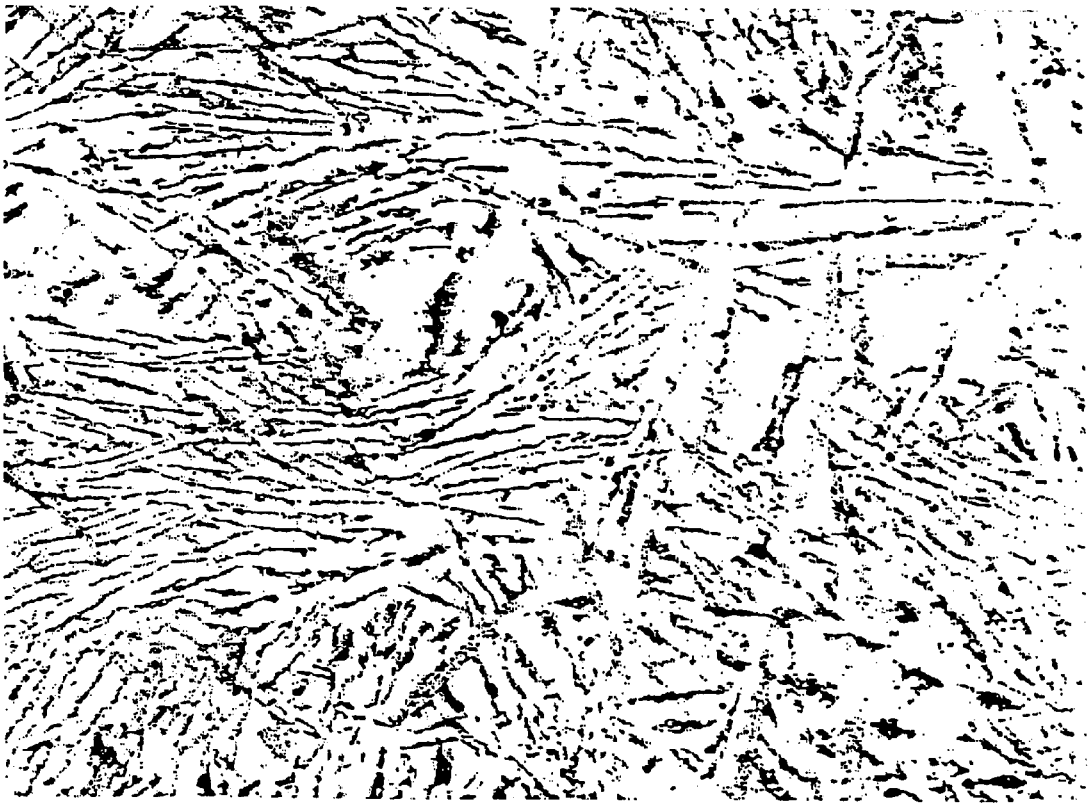
FIG. 3 is an optical micrograph of a solidified Al—Si melt from a melt container.
Figure 4:
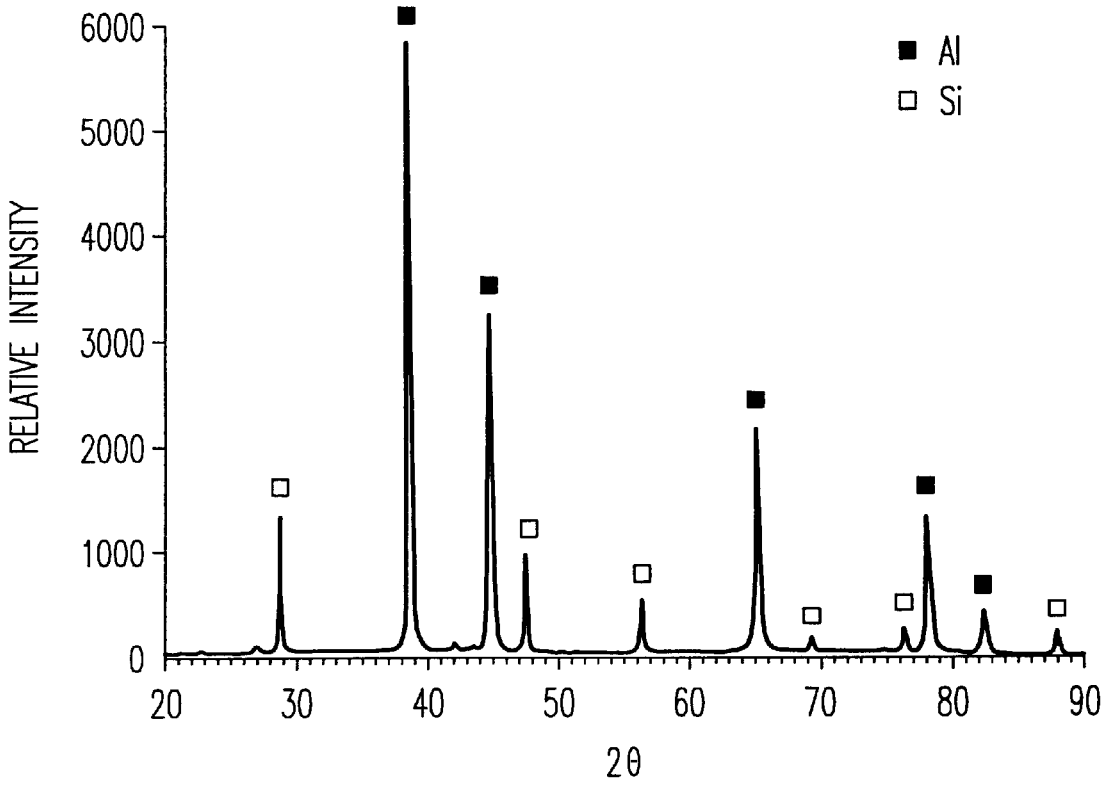
FIG. 4 is an X-ray diffraction pattern of a solidified Al—Si melt from a melt container.

FIG. 3 is an optical micrograph of a typical sample of solidified Al—Si melt in the melt container. The solidified melt in FIG. 3 shows an Al—Si eutectic microstructure. FIG. 4 is a typical X-ray diffractometer pattern of the solidified Al—Si melt in the melt container and shows X-ray diffraction peaks corresponding to Al and Si phases.

Figure 5:
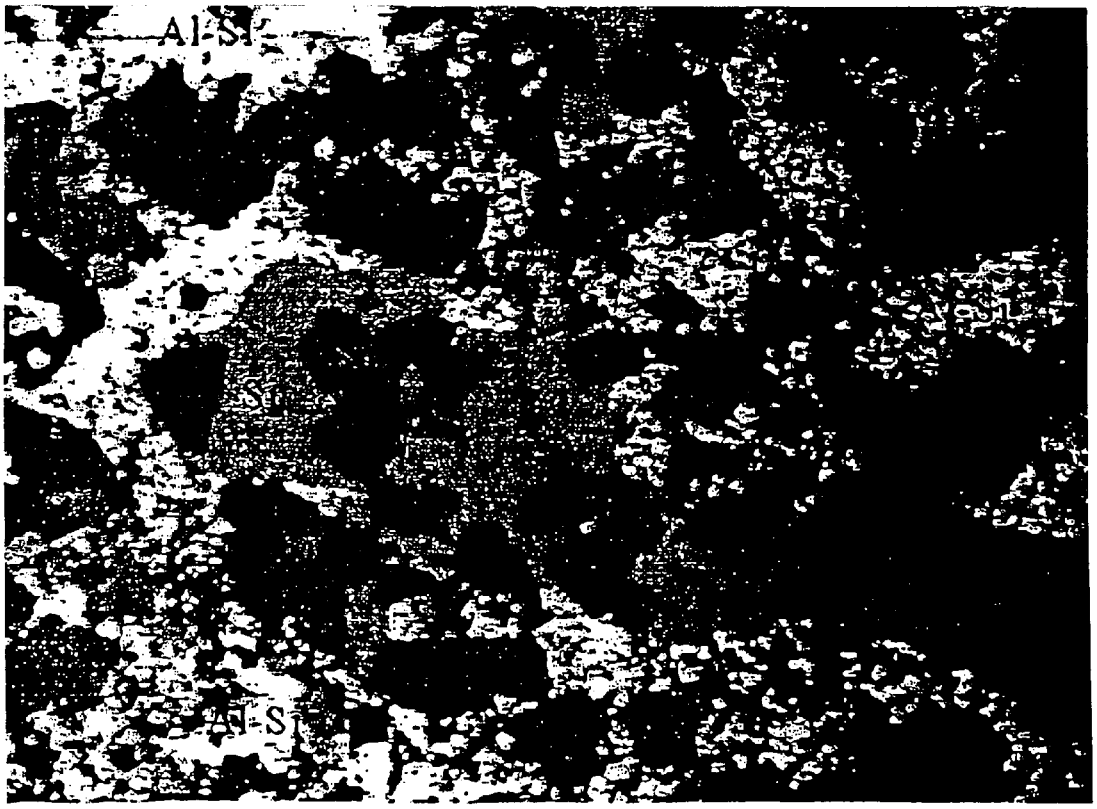
FIG. 5 is an optical micrograph of an Al/SiC composite from a composite collector.
Figure 6:
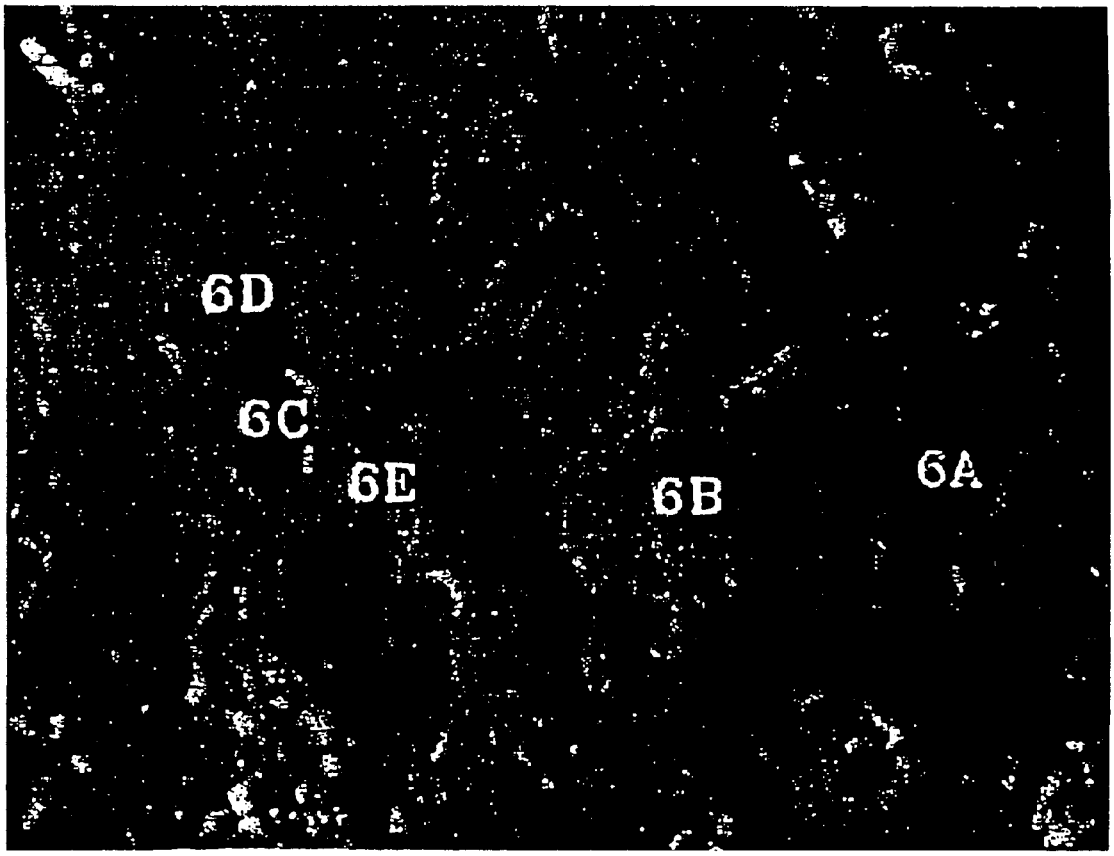
FIG. 6 is a scanning electron micrograph of an Al/SiC composite from a composite collector.
Figure 7A:
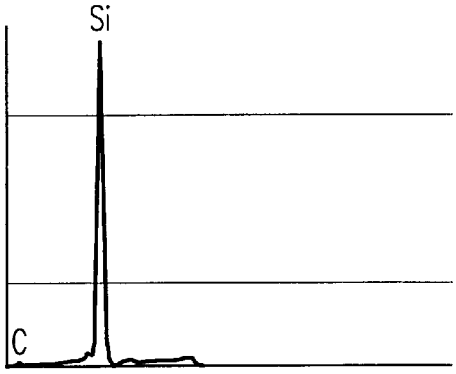
FIG. 7A–7E are electron microprobe analysis results for points 6A–6E of FIG. 6, respectively.
Figure 7B:
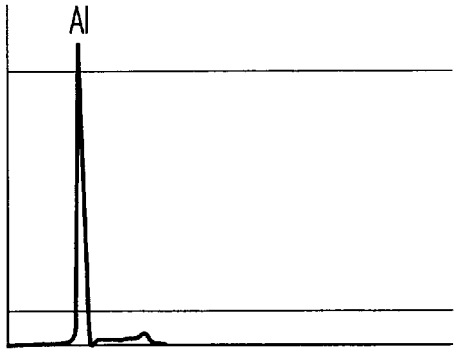
Figure 7C:
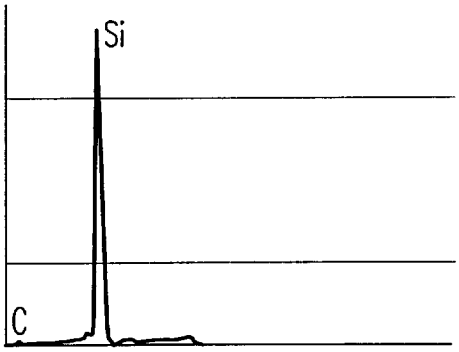
Figure 7D:
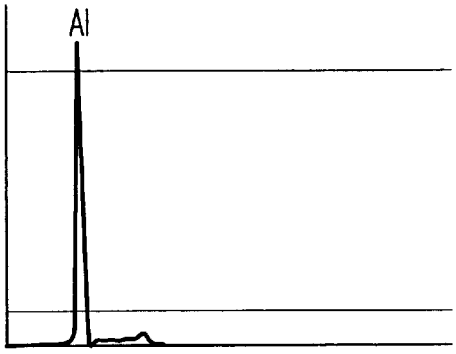
Figure 7E:
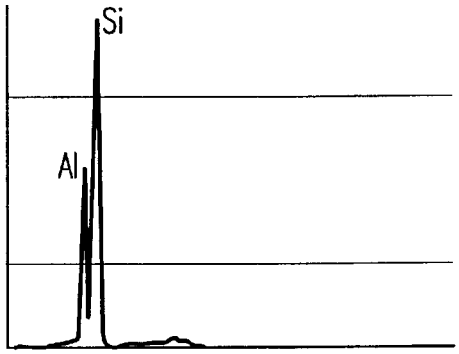
Figure 8:
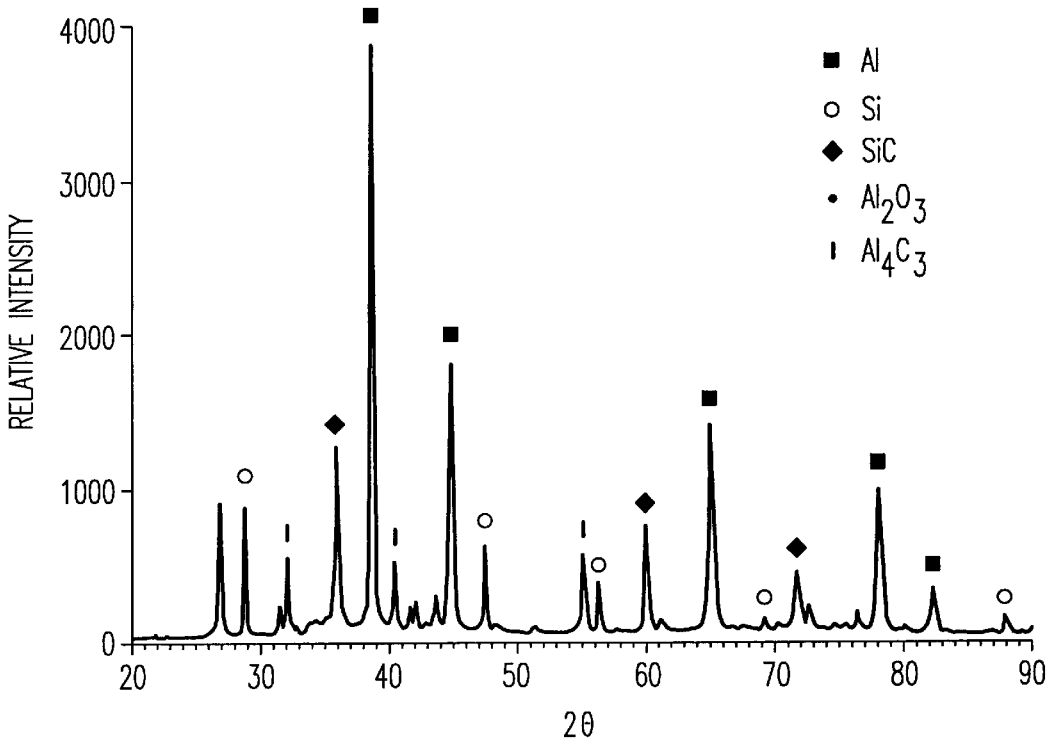
FIG. 8 is an X-ray diffraction pattern of a solidified Al/SiC composite from a composite collector.

FIG. 5 is an optical micrograph of a typical solidified Al/SiC composite sample obtained from the composite collector. The SiC particles in the composite are about 10 $\mu$m in diameter. FIG. 6 is a scanning electron micrograph of the Al/SiC composite from the composite collector. FIGS. 7A–7E are electron microprobe analysis results for points 6A–6E of FIG. 6, respectively. The microprobe results show that points 6A and 6C are SiC; points 6B and 6D are Al; and point 6E is an Al-Si eutectic. FIG. 8 is a typical X-ray diffractometer pattern of the solidified Al/SiC composite in the composite collector and shows X-ray diffraction peaks corresponding to Al, Si, SiC, $Al_2O_3$ and $Al_4C_3$ phases.

While the present invention has been described with reference to specific embodiments it is not confined to the specific details set forth, but includes various changes and modifications that may suggest themselves to those skilled in the art, all falling within the scope of the invention as defined by the following claims.

What is claimed is:

1. A method of making a metal/refractory composite, the method comprising bubbling a gas through a melt in a melt container to form a foam, where the gas comprises at least one gaseous refractory forming component and the melt comprises a metal matrix forming component and at least one molten refractory forming component;

reacting the at least one gaseous refractory forming component and the at least one molten refractory forming component to form solid refractory particles in the foam;

collecting the foam from the melt container in a composite collector;

allowing the foam in the composite collector to break to form a slurry including the refractory particles; and forming the metal/refractory composite.

2. The method according to claim 1, wherein the gas further comprises an inert gas.

3. The method according to claim 2, wherein the inert gas comprises argon.

4. The method according to claim 1, wherein the at least one gaseous refractory forming component comprises at least one element selected from the group consisting of boron, carbon, nitrogen, oxygen, silicon and transition metals.

5. The method according to claim 4, wherein the at least one gaseous refractory forming component further comprises at least one element selected from the group consisting of hydrogen and halogens.

6. The method according to claim 1, wherein the melt is an alloy.

7. The method according to claim 1, wherein the melt consists of one metallic element.

8. The method according to claim 1, wherein the metal matrix forming component comprises at least one metal selected from the group consisting of beryllium, magnesium, aluminum and titanium.

9. The method according to claim 1, wherein the at least one molten refractory forming component comprises at least one element selected from the group consisting of beryllium, boron, carbon, nitrogen, oxygen, magnesium, aluminum, silicon and transition metals.

10. The method according to claim 1, wherein the at least one gaseous refractory forming component comprises $CH_4$, the metal matrix forming component comprises Al, the molten refractory forming component comprises Si, and the refractory particles comprise SiC.

11. The method according to claim 1, wherein the refractory particles are ceramic.

12. The method according to claim 1, further comprising feeding the melt into the melt container.

13. The method according to claim 12, wherein the melt is fed into the melt container through a melt feed tube ending above the melt container.

14. The method according to claim 1, further comprising continuously feeding the melt into the melt container, wherein the collecting comprises continuously collecting the foam from the melt container in the composite collector.

15. The method according to claim 1, wherein the gas is introduced into the melt from at least one hole in a hollow tube.

16. The method according to claim 15, wherein the at least one hole in the hollow tube has a diameter of 1 mm or less.

17. The method according to claim 1, wherein the gas is introduced into the melt from at least one hole in the melt container.

18. The method according to claim 1, wherein the melt container comprises a packed bed.

19. The method according to claim 1, further comprising casting the slurry in a mold.

* * * * *